US007146889B2

(12) United States Patent
Kang

(10) Patent No.: US 7,146,889 B2
(45) Date of Patent: Dec. 12, 2006

(54) TOOL KIT

(76) Inventor: Hsin Fa Kang, P.O. Box 90, Tainan City (TW)

( * ) Notice: Subject to any disclaimer, the term of this patent is extended or adjusted under 35 U.S.C. 154(b) by 234 days.

(21) Appl. No.: 10/859,107

(22) Filed: Jun. 3, 2004

(65) Prior Publication Data

US 2005/0268754 A1 Dec. 8, 2005

(51) Int. Cl.
*B25F 1/00* (2006.01)

(52) U.S. Cl. ..... 81/437; 81/124.4; 81/440

(58) Field of Classification Search ..... 81/437, 81/124.4, 440, 439; D8/107, 85
See application file for complete search history.

(56) References Cited

U.S. PATENT DOCUMENTS 4,384,499 A * 5/1983 Shockley ..... 81/440
D412,823 S * 8/1999 Liao ..... D8/107
6,112,351 A * 9/2000 Hawkins et al. ..... 7/138
6,564,678 B1 * 5/2003 Wang ..... 81/124.4
6,751,819 B1 * 6/2004 Chuang ..... 7/100
6,868,760 B1 * 3/2005 Johnson ..... 81/440

* cited by examiner

*Primary Examiner*—Lee D. Wilson
*Assistant Examiner*—Alvin J. Grant

(57) ABSTRACT

A tool kit includes two plate grips respectively consisting of two half plates and a tool kit pivotally connected between two pairs of two half plates. All tools of the tool kit have a bolthole in its end, and a bolt passes through a front half plate and then through all the boltholes of all tools and then engages with another front half plate and then screws with a nut to hold tightly and pivotally the tools between the two front half plates. The two front half plates have respectively a rail groove in a rear lengthwise side and the two rear half plates have respectively a projecting rail to fit with the rail groove so as to stably combine the two pairs of the two half plates which hold the tool kit therebetween.

6 Claims, 7 Drawing Sheets

TOOL KIT

BACKGROUND OF THE INVENTION

1. Field of the Invention

This invention relates to a tool kit, particularly to one including two plate grips and a tool kit. The two plate grips have two pairs of two half plates and the tool kit is pivotally connected within the two pairs of the two half plates. All the tools of each tool kit are provided with a bolt hole for a bolt to pass therethoght, and then they are pivotally connected between each pair of the two half plates. The front half plate of each plate grip has a rail groove in the rear lengthwise side and the rear half plate of each plate grip has a projecting rail on a front lengthwise side to fit with the rail groove so that two pairs of two half plates can be combined together, respectively for holding a tool kit therebetween. Thus, the tool kit can be carried conveniently and the tool of the tool kit can be selected easily.

2. Description of the Prior Art

A common tool kit shown in FIG. 1 contains various tools for screwing or unscrewing screws, nuts, etc, and a tool box 10 for storing them therein. In using, a proper tool is picked out and then connected with a handle 11 for placing the tool on a nut, a screw, bolt, etc. Then the handle is rotated to screw or detach a nut. A conventional tool kit 1 is generally kept in a tool box and carried along for various uses. It is often that the tool kit is taken out and misplaced so that it is easily lost, and it is very difficult to keep them in order.

SUMMARY OF THE INVENTION

The objective of the invention is to provide a portable tool kit which offers convenience.

The feature of the invention is two plate grips. Each plate grip consists of a front half and a rear half plate so as to form two pairs of two half plates. Bolts are used to pivotally connect various tools of a tool kit between each pair of the front half plate and the rear half plate. Every tool has a hole in one end for a bolt to pass therethoguth so as to be screwed with one of the two half plates to keep the various tools in order therebetween. Further, the front half plate of each plate grip is provided with a rail groove in a front lengthwise side and the rear half plate of each plate g rip is provided with a projecting rail to fit with the rail groove, combining the two front half plates or the two rear half plates together so as to hold pivotally the various tools of the tool kit between them for carrying around conveniently.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
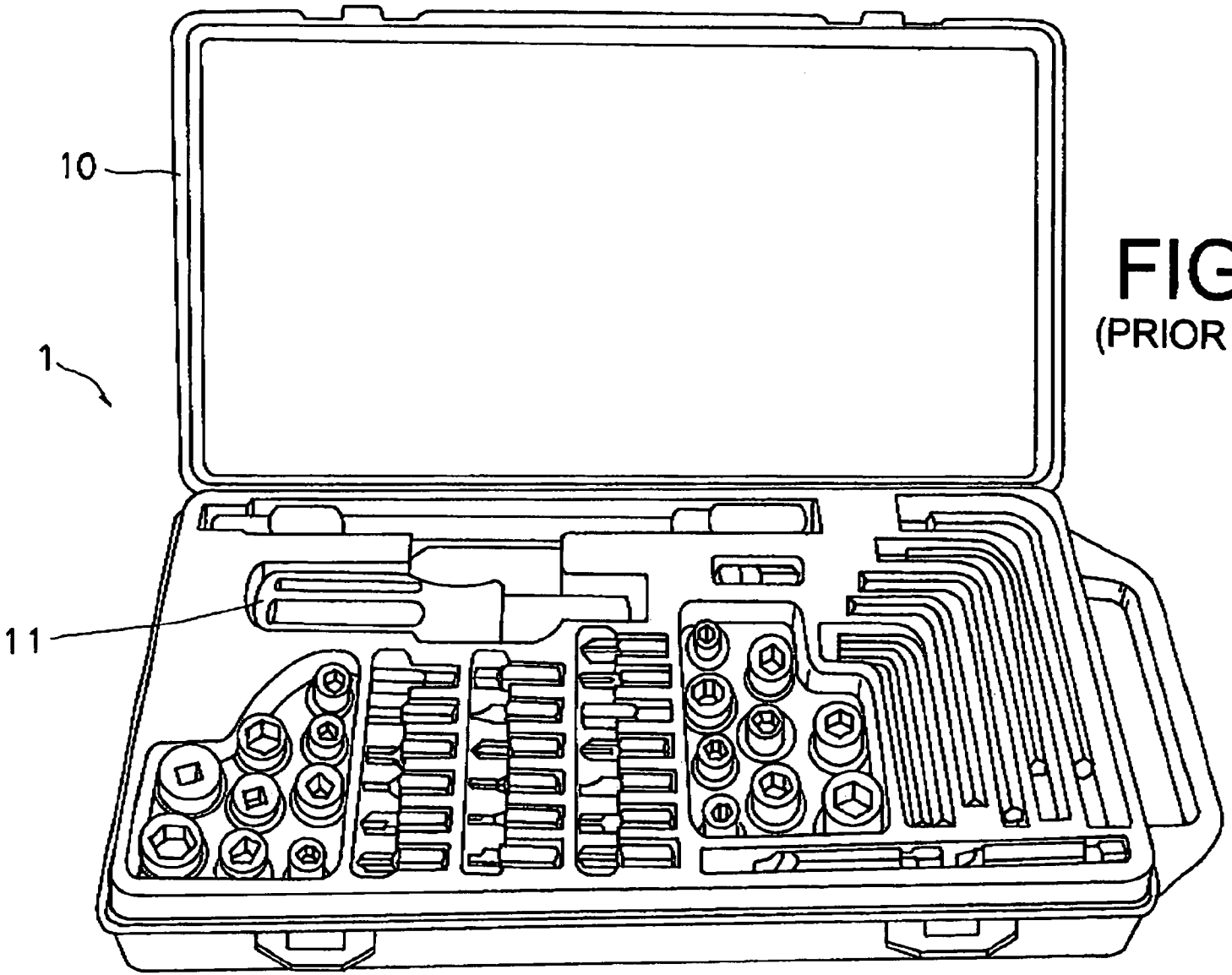
FIG.1 (PRIOR ART)
FIG. 1 is a perspective view of a conventional tool kit stored in a toolbox.
Figure 2:
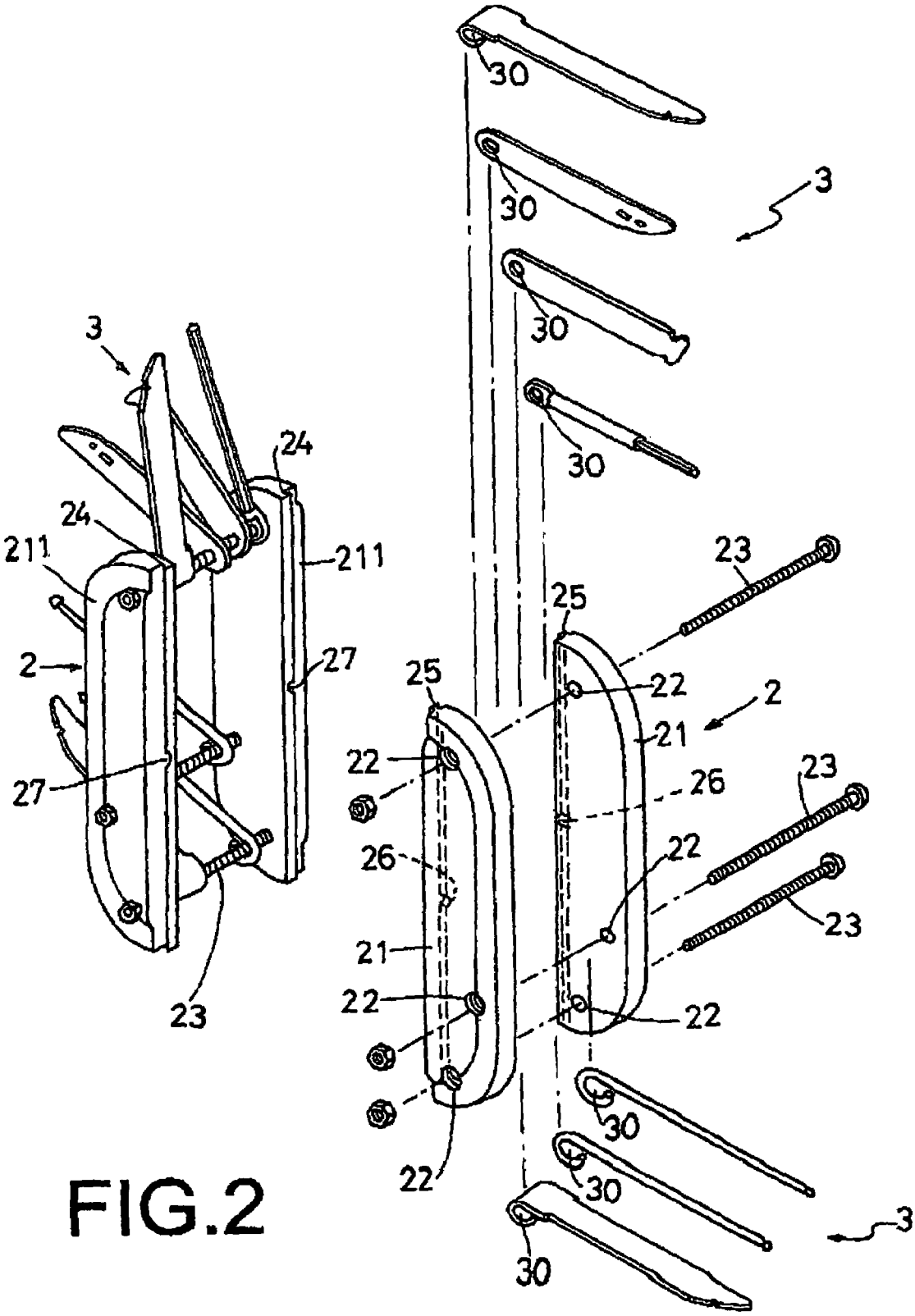
FIG. 2 is an exploded perspective view of a tool kit for taking off an automobile audio set in the present invention.
Figure 3:
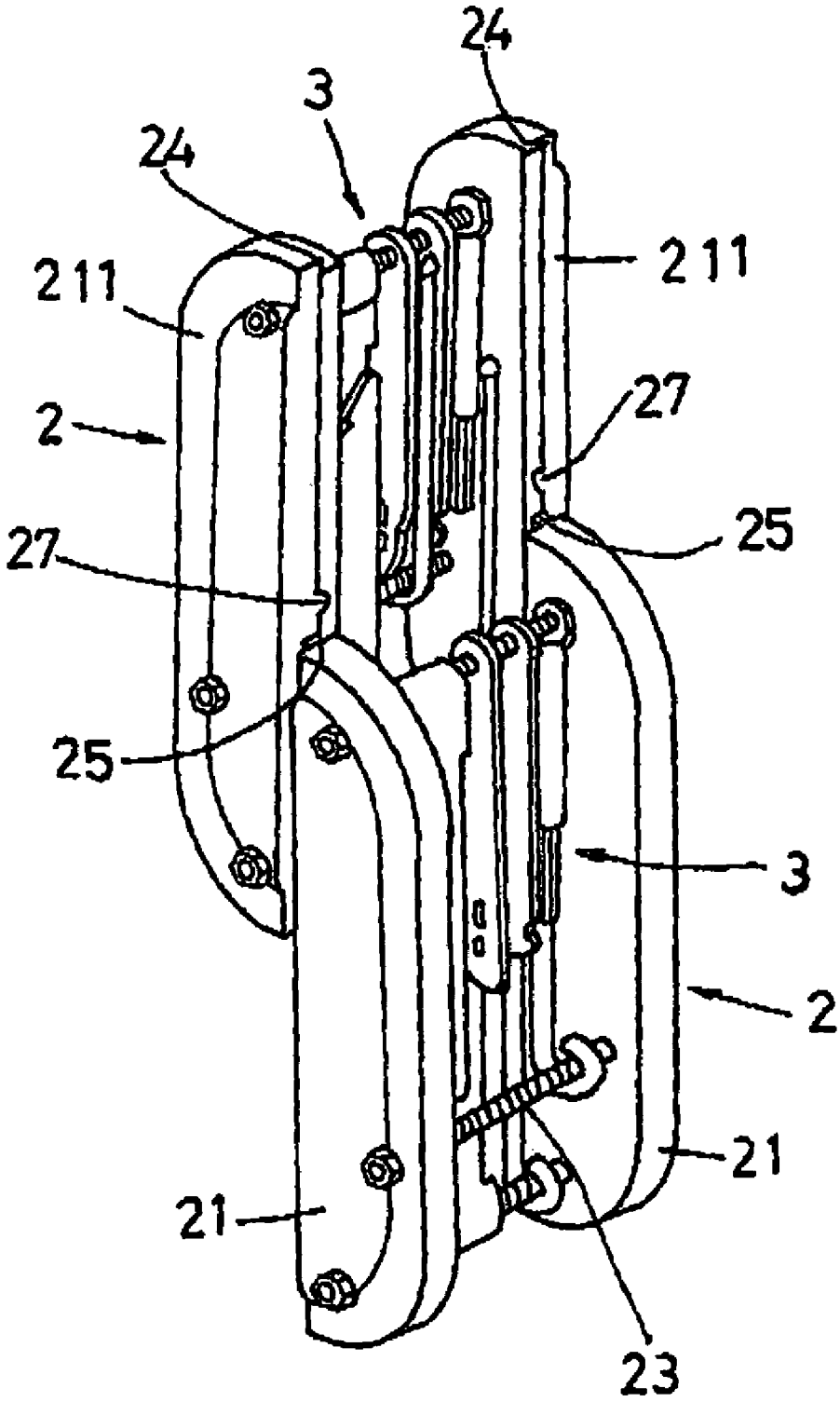
FIG. 3 is a perspective view of the tool kit being held orderly between two pairs of two half plates of the plate grips in the present invention.
Figure 4:
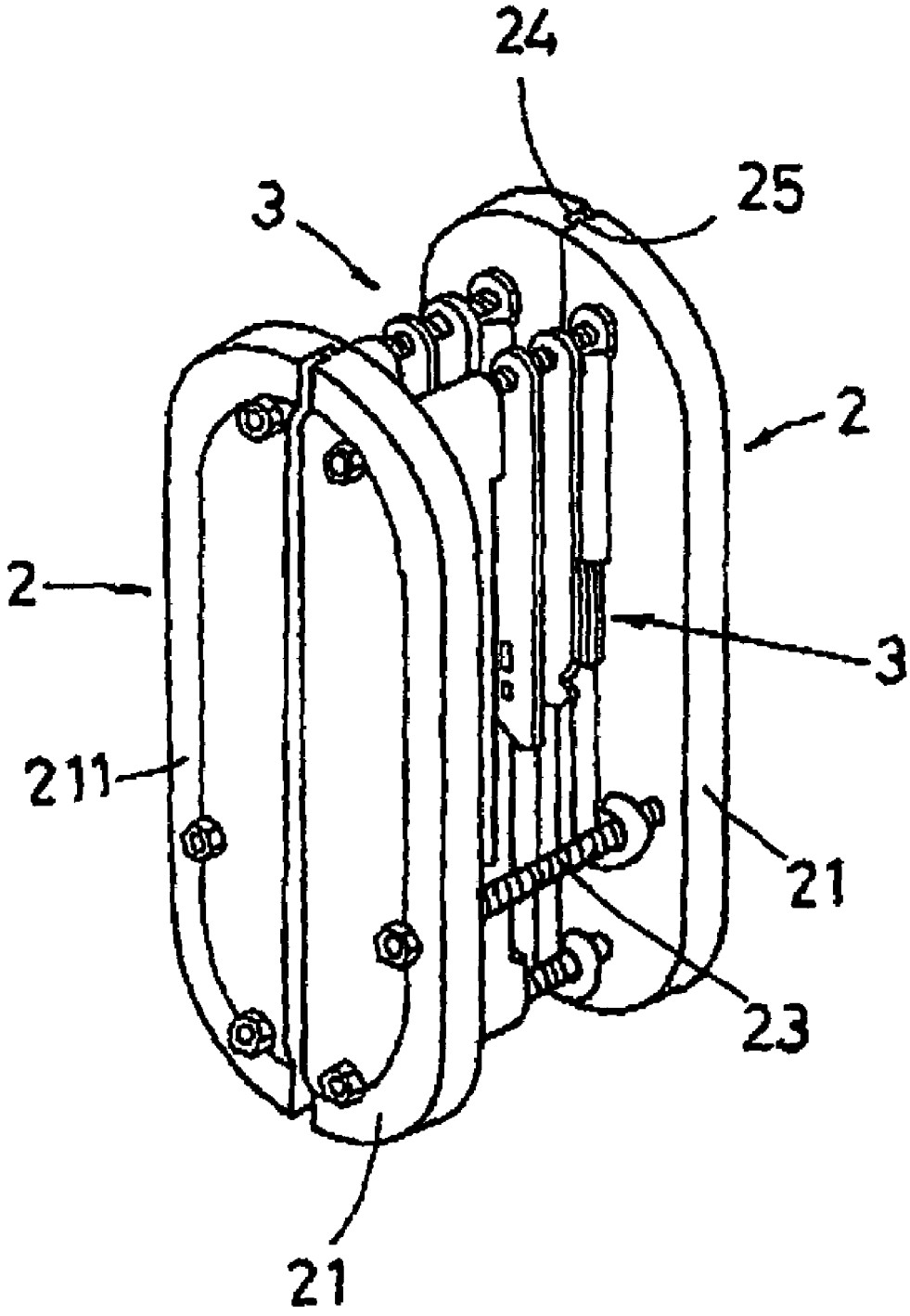
FIG. 4 is a perspective view of the tool kit pivotally held between the two pairs of two half plates of the plate grips in the present invention.

A first embodiment of a tool kit in the present invention, as shown in FIGS. 2, 3 and 4, includes two plate grips 2 respectively consisting of a front half plate 211 and a rear half plate 21 combined together. The front half plate 211 and the rear half plate 21 of the plate grip 2 are connected with each other by using a bolt 23, so as to constitute two pairs of two half plates 21, as shown in FIG. 3. Each front half plate 211 and each rear half plate 21 has a plurality of threaded holes 22, and each tool of the tool kit 3 has a bolthole 30 at one end. Then the threaded holes 22 and all bolt holes 30 of the tools are aligned in line and then an elongate bolt 23 passes through one of the front half plate 211 or the rear half plate 21 and then screws with the other front half plate 211 or the rear half plate 21, keeping all the tools of the tool kit 3 between the two front half plate 211 or the two rear half plates 21. Further, the front half plate 211 has a rail groove 24 of a dovetail shape in the rear lengthwise side, and the rear half plate 21 of the same pair has a projecting rail 25 of the same dovetail shape in the front lengthwise side to fit in the rail groove 24 so as to combine stably the front half plate 211 and the rear half plate 21. In addition, the rail groove 24 has a projecting ball 27 and the rail projection 25 has a recess 26 to correspond with the projecting ball 27 to engage with each other to keep the front half plate 211 and the rear half plate 21 stably in place, not to slide off.

Figure 5:
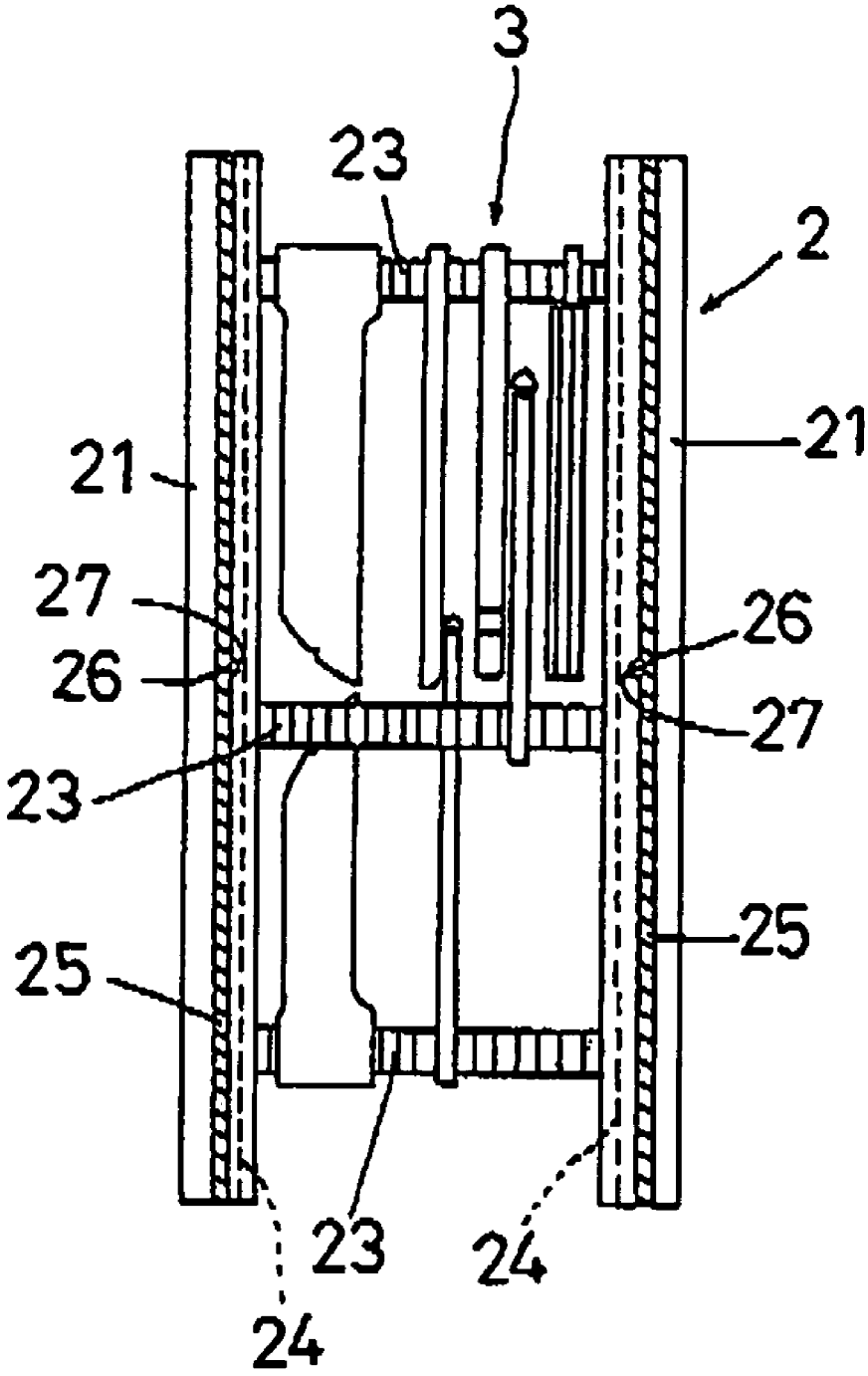
FIG. 5 is a cross-sectional view of FIG. 4.

The first embodiment of the tool kit in the invention pertains to the removal of an automobile audio set, and then the pair of the two front half plates 21 are separated from the pair of the two rear half plates 21 as shown in FIG. 3 by pulling the rear pair from the front pair. Next, a user selects a proper tool needed and swings it out. Then the user grips the two plate grips 2 with one hand and the tool with other hand, pushing the tool into the gap between the audio set and the case to pry the audio set out with easiness and convenience. After used, the user swings the tool back between the two plate bodies 2, and the two pairs of the half plates 21 are combined together by fitting the projecting rail 25 with the rail groove 24, by engaging the projecting ball 27 with the recess 26 as shown in FIG. 5. Thus using the tool kit saves time and there is no fear of losing any tool from the tool kit.

Figure 6:
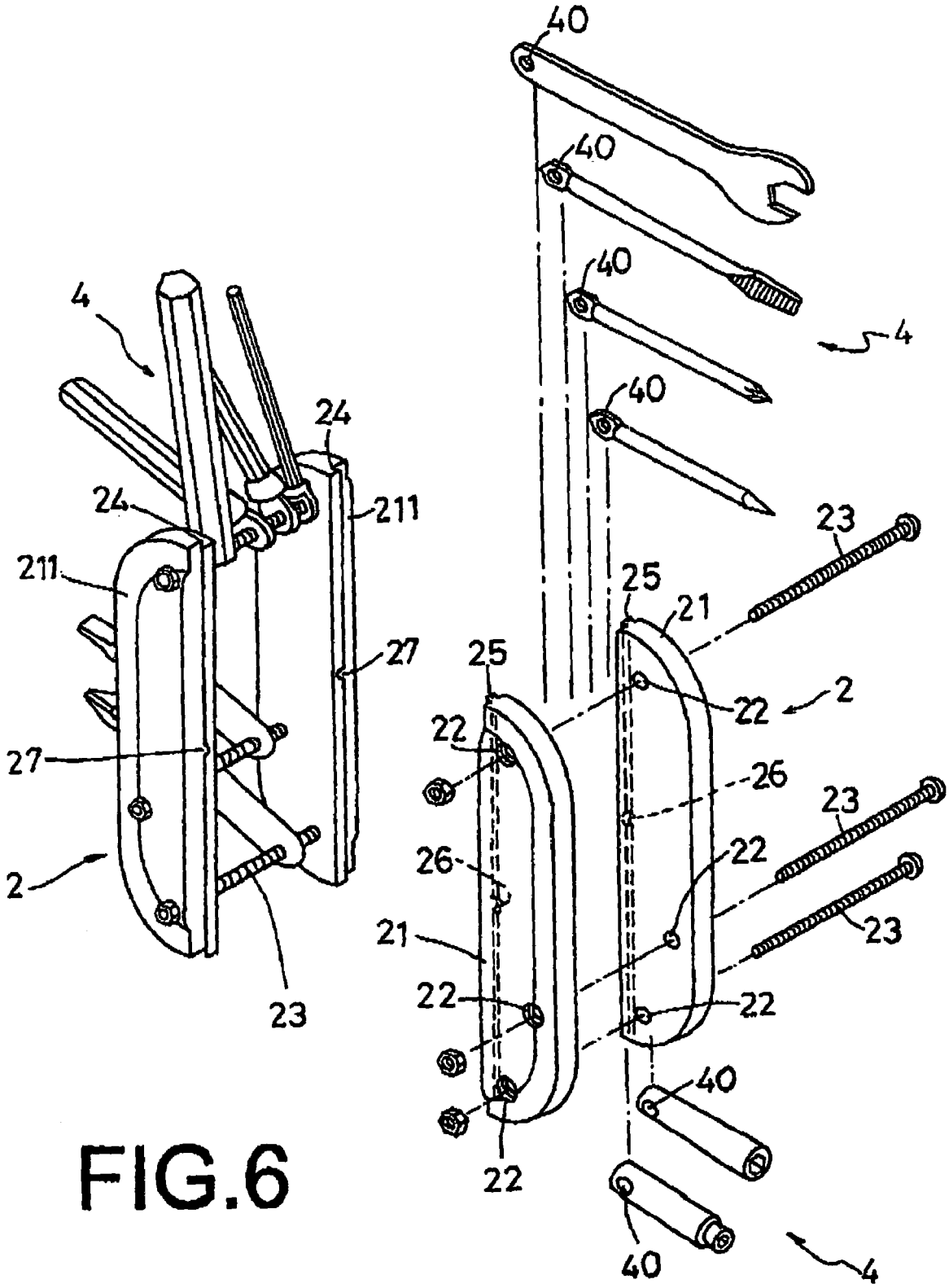
FIG. 6 is an exploded perspective view of a second embodiment of a tool kit for taking off threaded components in the present invention; and, FIG. 7 is a perspective view of a tool of the tool kit of the second embodiment shown in FIG. 6 optionally swung out.
Figure 7:
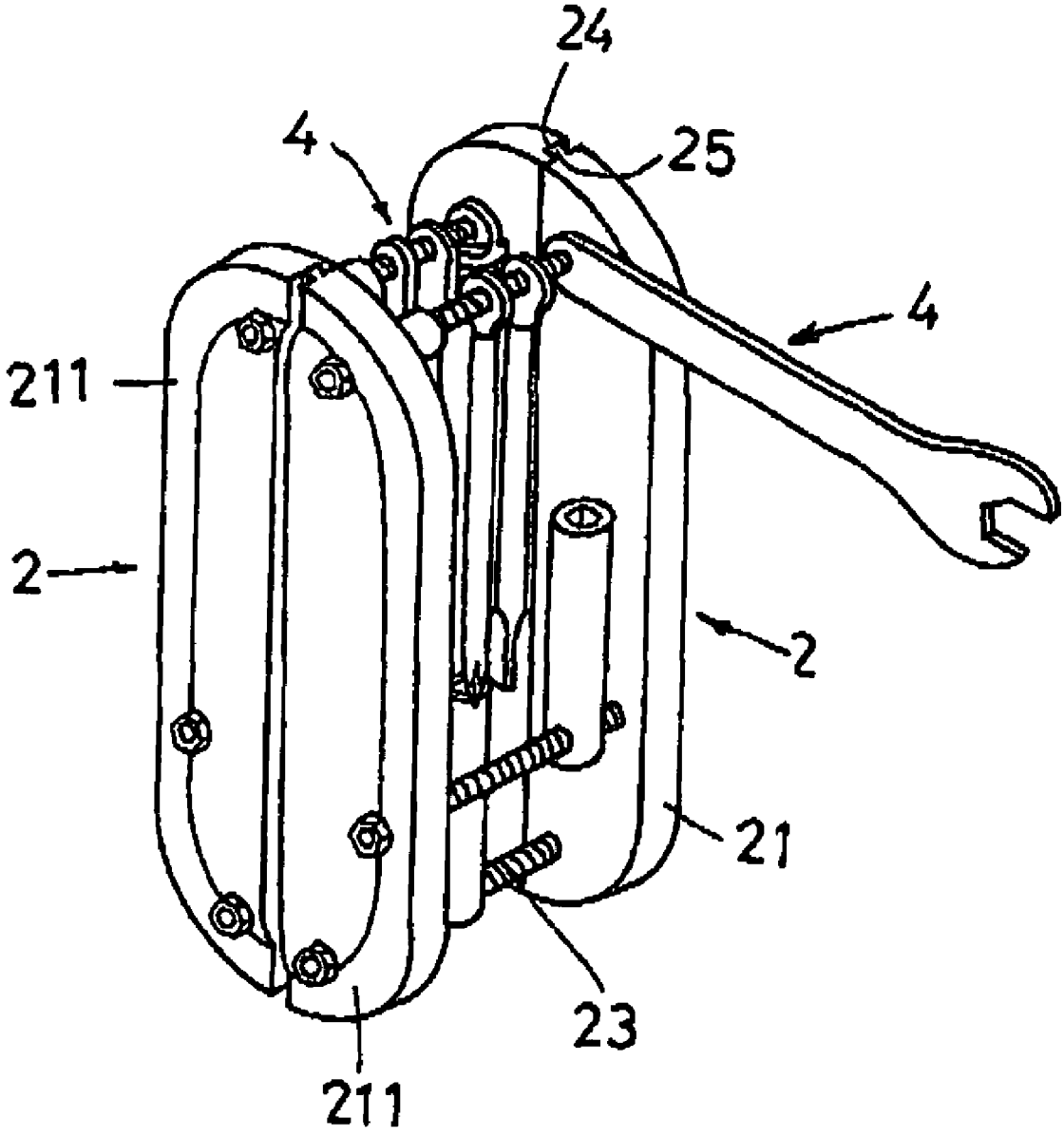

A second embodiment of a tool kit in the present invention is shown in FIGS. 6 and 7, including two plate grips 2, and a tool kit 4 respectively and pivotally connected between two pairs of two front half plates 211 or two rear half plates 21. Each tool of each tool kit 4 is provided with a bolt hole 40 in one end so that all the bolt holes 40 of all the tools are aligned to the shaft hole 22 of the two plates 21 in the way used in the first embodiment, and then a bolt 23 firstly passes through the front half plates 211 or the rear half plate 21. Then it passes through all the bolt holes 40 of the tools and then engages with the other front half plates 211 or rear half plates 21 so all the tools of the tool kit are pivotally connected between each of the two pairs of the half plates 21. When a user wants to screw off a nut, a screw, a bolt or the like, the two pairs of the half plate grip 21 are separated from each other by pulling them respectively in opposite directions. Then the user swings a proper tool out, and holds tightly the two plate grips 2 with one hand and rotate the tool with the other hand with ease for screwing the nut. After using the tool, the user may swing the tool back between the two half plates 21, and the two pairs of the half plates 21 are combined together by fitting the projecting rail 25 with the rail groove 24, with the projecting ball 27 engaging the recess 26 to secure the two pairs of the two half plates 21 together stably. Thus any tool of the tool kit 4 never gets lost and can also be used easily and conveniently.

While the preferred embodiments of the invention have been described above, it will be recognized and understood that various modifications may be made therein and the appended claims are intended to cover all such modifications that may fall within the spirit and scope of the invention.

What is claimed is:

1. A tool kit comprising two plate grips respectively consisting of two plates, wherein each of said plates comprises one front half plate and one rear half plate, at least a tool kit pivotally connected between each pair of two half plates, said tool kit consisting of a plurality of separate tools all provided with a bolt hole in one end, a bolt passing through one of said front half plates and also through said bolt holes of all tools and then engaging with the other front half plate and screwing with a nut at the outer surface of the other front half plate to tightly hold the pair of said two half plate, the front half plate of each said plate grip provided with a rail groove in a rear lengthwise side, the rear half plate of each said plate grip provided with a projecting rail on a front lengthwise side, said rail groove fitting with said projecting rail for combining said front half plate with said rear half plate to form said plate grip.

2. The tool kit as claimed in claim 1, wherein said rail groove of said front half plate is shaped as a dovetail, and said projecting rail of the rear half plate is correspondingly shaped to engage said groove.

3. The tool kit as claimed in claim 1, wherein said rail groove of said front half plate has a projecting ball at a proper location, and said projecting rail has a recess to correspond to said projecting ball, said projecting ball engaging with said recess to keep the front and the rear half plate from sliding off each other.

4. The tool kit as claimed in claim 1, wherein each said plate grips is constituted of two half plates and at least one bolt connecting each pair of the two half plates.

5. The tool kit as claimed in claim 1, wherein said tool kit consists of a plurality of separate tools used for taking off an automobile audio set.

6. The tool kit claimed in claim 1, wherein said tool kit consists of a plurality of separate tools used for screwing off threaded components such as nuts or the like.

* * * * *